United States Patent [19]

Von Der Ley et al.

[11] Patent Number: 4,794,846

[45] Date of Patent: Jan. 3, 1989

[54] PROPORTIONAL ACTION VALVE WITH A BIASED SPRING UNPROPORTIONATELY VARIABLE TO THE LOAD PRESSURE

[75] Inventors: Heinz-Joachim Von Der Ley; Reiner Schulz; Bernd Henchoz, all of Remscheid, Fed. Rep. of Germany

[73] Assignee: Barmag AG, Remscheid, Fed. Rep. of Germany

[21] Appl. No.: 931,686

[22] PCT Filed: Feb. 21, 1986

[86] PCT No.: PCT/DE86/00066

§ 371 Date: Oct. 22, 1986

§ 102(e) Date: Oct. 22, 1986

[87] PCT Pub. No.: WO86/04963

PCT Pub. Date: Aug. 28, 1986

[30] Foreign Application Priority Data

Feb. 23, 1985 [DE] Fed. Rep. of Germany ..... 3506432

[51] Int. Cl.[4] ..... F15B 13/04

[52] U.S. Cl. ..... 91/451; 137/596.13

[58] Field of Search ..... 91/451; 137/596.13

[56] References Cited

U.S. PATENT DOCUMENTS

| | | | |
|---|---|---|---|
| 3,828,813 | 8/1974 | Haussler | 137/596.13 |
| 4,282,898 | 8/1981 | Harmon et al. | 137/596.13 |
| 4,303,091 | 12/1981 | Hertell et al. | 137/117 |

FOREIGN PATENT DOCUMENTS 2428287 1/1975 Fed. Rep. of Germany .

*Primary Examiner*—Gerald A. Michalsky

*Attorney, Agent, or Firm*—Bell, Seltzer, Park & Gibson

[57] ABSTRACT

A hydraulic proportional action valve apparatus includes a throttle valve, and a pressure balance which permits adjustment of the pressure difference between a supply pressure and a consumer pressure. The pressure balance, which may be provided with a spring, is hydraulically supported. A supporting assembly, which is provided for this purpose, is biased by a constantly controllable pressure-regulating valve. The control of the pressure-regulating valve may occur as a function of hydraulic parameter, such as, for example, the load pressure or the pilot pressure of the throttle valve.

4 Claims, 6 Drawing Sheets

PROPORTIONAL ACTION VALVE WITH A BIASED SPRING UNPROPORTIONATELY VARIABLE TO THE LOAD PRESSURE

This invention relates to proportional action valve apparatus for a hydraulic power system of the type in which a pump and a load and a tank are interconnected by an adjustable throttle valve; and in which there is further provided, for the purpose of adjusting a constant pressure differential upon the throttle valve, a pressure balance having a piston that is biased by the pump pressure in a first or opening direction, and that is biased by the load pressure and by an additional counterforce in an opposite second or closing direction.

BACKGROUND OF THE INVENTION

German Offenlegungsschrift 23 04 334 and corresponding U.S. Pat. No. 3,828,813 disclose a control apparatus, for achieving load-independent regulation of the flow in a hydraulic power system or the like, in which a pressure difference balance (hereinafter referred to as pressure balance) device serves to maintain a constant pressure difference between a pump pressure line and an associated consumer. The pressure balance is primarily comprised of a piston that is movable within a cylindrical chamber. A connection between the chamber and the pump pressure line subject one side of the piston to the pump pressure. Another connection subjects the other side of the piston to the system load or consumer pressure. Additionally, the other side of the piston is engaged by and subjected to the biasing force of a compression spring, which is the so-called balance spring. The piston takes a balanced or equilibrium position which is determined and defined by the pump pressure on the one hand, and by the sum of the load pressure and the spring force on the other hand. The cylindrical chamber of the pressure balance is connected to the fluid tank of the hydraulic system by an opening which is opened or closed to a greater or lesser extent by a control edge of the piston, and which when open permits the passage into the tank of some more or less large portion of the flow of hydraulic fluid delivered by the pump.

European Pat. No. 15492 and corresponding U.S. Pat. No. 4,303,091 disclose a pressure balance whose operation is further assisted by a hydraulic support assembly having a hydraulically biased differential piston. The piston is adjustable between an idling position and a working position, and supports an abutment of the balance spring of the pressure balance. An adjustable stop element extending to the exterior of the hydraulic support assembly permits adjustment of its spring supporting action.

An object of the present invention is the provision of a proportional action valve apparatus that is so constructed as to permit changes to be made in its operating characteristics, during operation of the apparatus and by varying the working position of the spring abutment of the pressure balance, such that at desired times the consumer can be hydraulically driven independently of the load at either a constant speed and finely adjusted pressure differential, or at its highest possible speed and in accordance with some other different operating characteristic. As used herein, the term "characteristic" means the dependent relationship, which may be represented by a diagram, between the volume flow of fluid through the throttle valve of the apparatus and the control signal or force that actuates the throttle valve.

SUMMARY OF THE INVENTION

The foregoing object is accomplished by the provision, in association with a proportional action valve apparatus of the hereinbefore described type, of controllable pressure-regulating valve means for effecting hydraulic adjustment of the support for the piston of the pressure balance and, in a particular embodiment, support of the abutment for the balance spring. The pressure-regulating valve preferably is continuously controllable so that all pressure values between a maximum pressure and a minimum pressure can be realized by appropriate adjustment of the pressure-regulating valve.

Preferably the apparatus of the invention includes means for amplifying the counteracting force of the balance spring, which means is hydraulically actuated and includes an adjusting piston that is movable in a guide cylinder and is operatively connected by a rod or plunger with the abutment of the balance spring.

In one specific embodiment of the invention, the amplifier of the counteracting force consists of the above-noted guide cylinder, adjusting piston and plunger components, and is connected via a pressure inlet, a pressure line and the pressure-regulating valve with a supply of pressurized fluid. In an expanded embodiment a cylindrical stem within a bore extends coaxially from the adjusting piston and the plunger upon the piston side distal from the plunger. The end portion of the bore distal from the adjusting piston receives, via a pressure equalizing channel, the pressure present within the chamber containing the balance spring, and forms a pressure equalizing chamber. The free end surface of the stem that confronts the pressure equalizing chamber preferably is of the same size as the end surface of the plunger. For the purpose of relieving pressure and discharging leakage fluid, that portion of the control cylinder adjacent the balance spring preferably is connected to a suitable fluid receiving tank of the system.

Pressurized fluid may be supplied to the regulating valve of the counterforce amplifier from different sources so long as the adjusting piston is of appropriate diameter. For example, the pressure-regulating valve may be biased by the pump pressure, by the control pressure of the system, and also by the load pressure. However, the provision of a separate pressure supply system for the amplifier of the counteracting force is particularly advantageous.

Control of the supporting assembly may be achieved by an electric, hydraulic or mechanical signal initiated manually and adapted to obtain a specific type of performance or behavior. For example, it is possible by appropriate control and adjustment of the supporting assembly to so bias the piston of the pressure balance as to cause the piston-controlled bypass between the pump and the tank to remain closed, whereupon the entire output of the pump is available to actuate a drive motor or other consumer. This may be useful, for example, if rapid motion is desired during idling operation of the drive motor, such as when the motor is a lifting cylinder in an elevator.

The supporting assembly may also be controlled in response to and as a function of the control signal by which the throttle valve of the apparatus is adjusted. This allows a particular control signal for the throttle valve to be linked or correlated with a particular control signal for the supporting assembly, such that a particular characteristic of the throttle valve, as for example a quick motion, is influenced by the supporting assembly. For example, the control signal directed to the throttle valve to produce a particular motion may be used in a way causing the supporting assembly to further compress or tighten the balance spring, thereby closing the bypass between the pump and the tank of the hydraulic power system.

The control signal for the supporting assembly may also be derived from the load pressure of the consumer of the hydraulic power system. This will allow the throttle valve characteristics to be made dependent upon the load of the consumer, and to be changed by adjustment of the supporting assembly. For example, if there were no pressure load, the absence of a corresponding load at the supporting assembly might cause the latter to so adjust the piston of the pressure balance as to result in closure of the bypass between the pump and the tank of the hydraulic power system. In this instance the consumer output motion would be fast. The load is continuously measured. The supporting assembly is biased by a signal that is a function of such load and that reduces the speed of the consumer, in a continuous or stepwise fashion, as the load increases.

A valve apparatus with novel properties and a particularly novel characteristic will result if the throttle valve is hydraulically precontrolled by a pilot servo valve, and if the supporting assembly is biased by the pilot pressure. In this instance the supporting assembly may operate directly, i.e. without an interposed spring, on the piston of the pressure balance. In this situation the piston of the supporting assembly preferably has a larger piston surface than the piston of the pressure balance. The supporting assembly preferably is controlled by a two-way valve having a central outlet connected to the supporting assembly and having lateral inlets connected to respective ones of two pilot pressure channels of the servo pilot valve.

DESCRIPTION OF THE DRAWINGS

Embodiments of the invention will be hereinafter described in conjunction with the accompanying drawings, in which.

DESCRIPTION OF THE PREFERRED EMBODIMENTS

Figure 1:
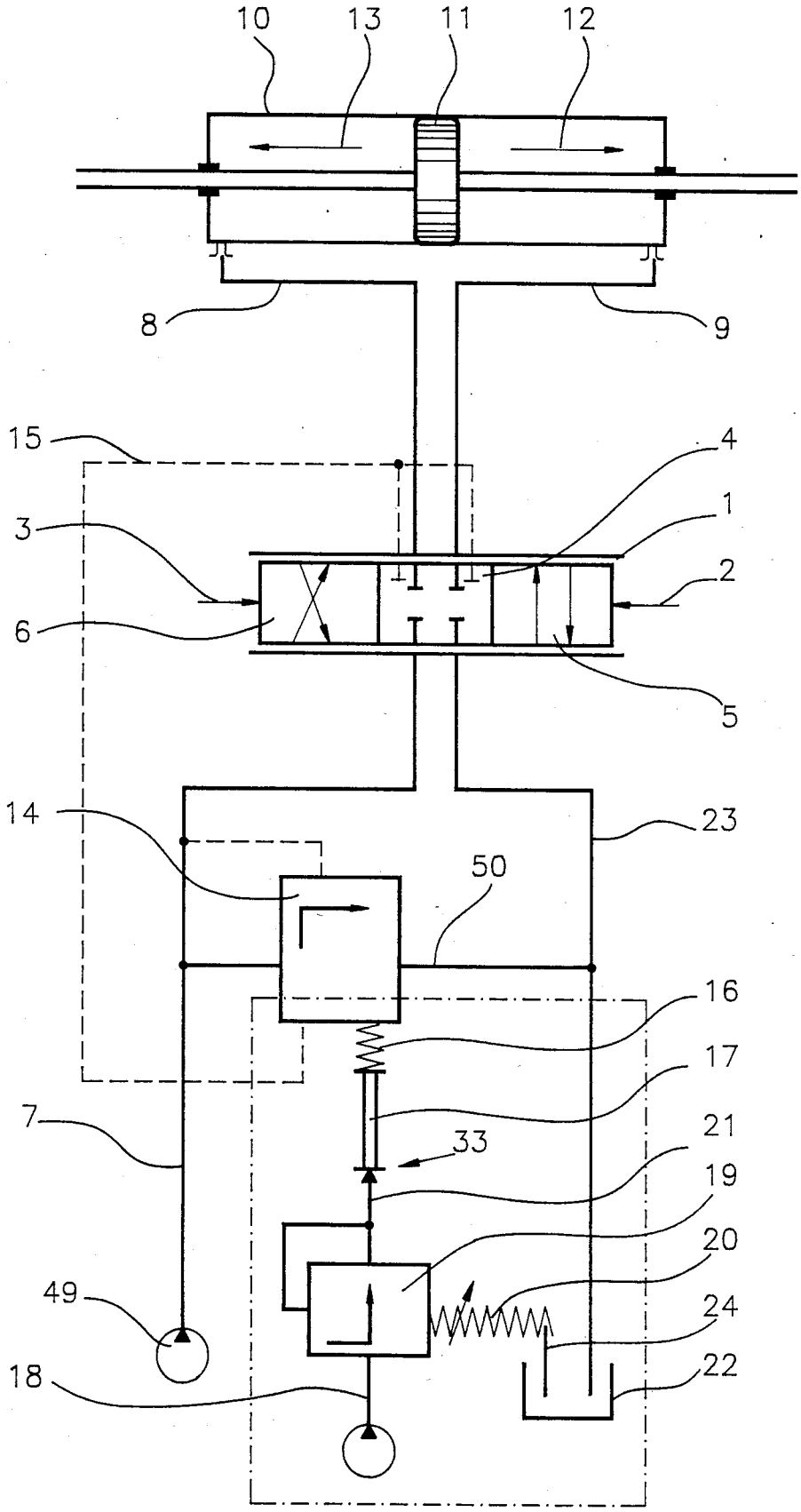
FIG. 1 is a schematic circuit diagram of a hydraulic power system including valve apparatus in accordance with the present invention.

The hydraulic circuit of FIG. 1 includes a consumer in the form of working cylinder 10 having a piston 11 that is driven in the two opposite directions of motion indicated by the arrows 12, 13. To this end, cylinder 10 is connected by lines 8, 9 to a multiway (4/3) valve 1 that is connected by a pump line 7 to a pump 49, and by a line 23 to a sump or tank 22. A bypass duct 50 and a section of line 23 also connect pump line 7 with tank 22. Bypass duct 50 is opened or closed by a pressure balance 14 which may be and illustratively is of the general type disclosed in European patent 15492 and thereto corresponding U.S. Pat. No. 4,303,091. A spring 16 of pressure balance 14 is operatively connected to a counterforce amplifier supporting assembly 17 which supports the abutment 27 (FIG. 3) of balance spring 16.

Figure 3:
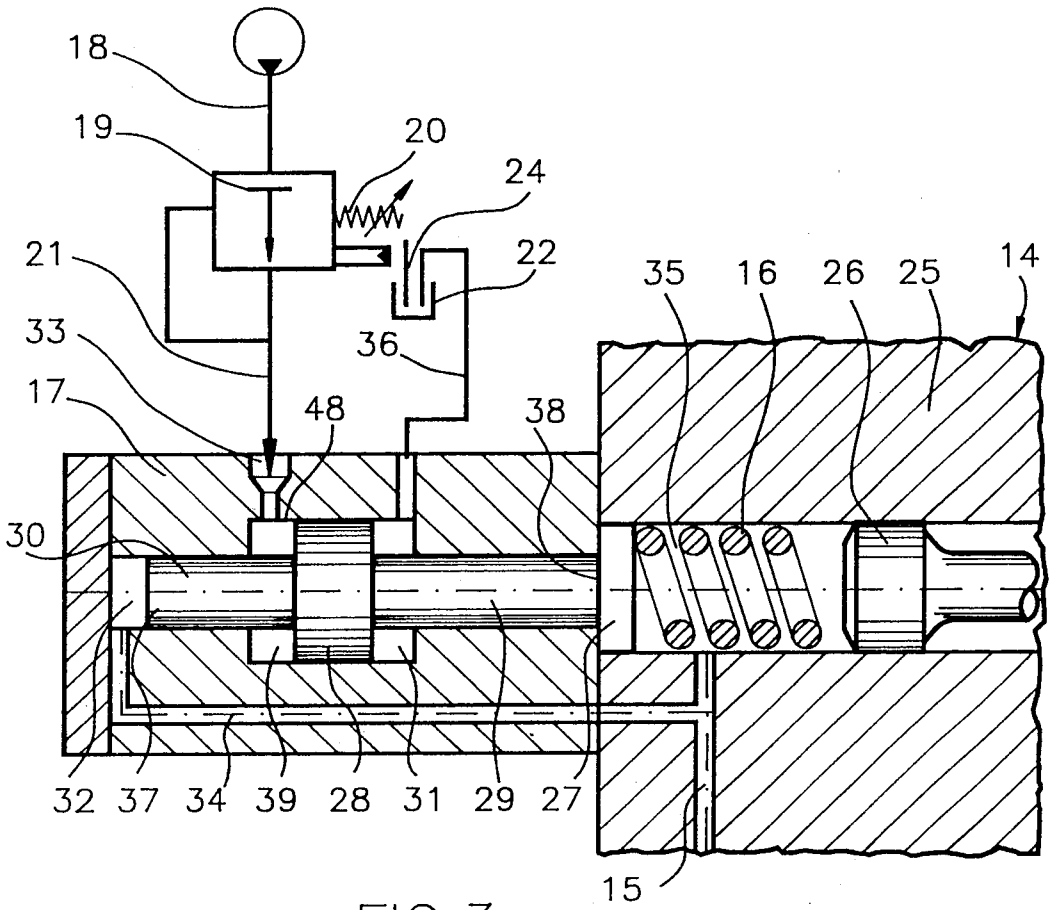
FIG. 3 is a partially schematic and partially sectional view of counterforce amplifier and related components enclosed by the dash-dot line in FIG. 1.

FIG. 3 shows in greater detail the amplifier supporting assembly 17 and part of the pressure balance 14, which are shown only schematically in FIG. 1. The casing 25 of pressure balance 14 has a piston 26 mounted for movement therein. Piston 26 is biased by the pump pressure which is imposed upon its unillustrated (right, as viewed in FIG. 3) side or end. At its illustrated (left) side or end, balance piston 26 is supportively engaged by, and is subjected to the biasing force of, spring 16 of balance 14. Balance piston 26 is also biased (in a rightward direction, as viewed in FIG. 3) by fluid under load pressure which is introduced into spring chamber 35 of balance 14 through line 15.

An adjusting supporting piston 28 is mounted within and movable axially of a cylinder 48 provided within the casing of supporting assembly 17. A pressure inlet 33 communicates with that part 39 of cylinder 48 distal from spring 16. The cylinder part 31 adjacent spring 16 has an outlet 36 communicating with tank 22. Operative interconnection between piston 28 and the abutment 27 of balance spring 16 is established by a plunger 29 on abutment 27. The front (right, as viewed in FIG. 3) end surface 38 of plunger 29 is subjected to the load pressure within spring chamber 35. Attached to the back (left, as viewed in FIG. 3) side of piston 28 is a cylindrical stem 30 located within a bore extending from cylinder 48 and having a back (left) side or end 37 located within end part 32 of such bore. A pressure equalization channel 34 interconnects the bore part 32 with spring chamber 35 so that the free end 37 of stem 30 is subjected to the biasing force of the load pressure present within spring chamber 35. As a result, the entire system comprised of the cylinder stem 30, piston 28 and plunger 29 is pressure balanced with respect to the load pressure. Supporting piston 28 therefore is operable exclusively by the hydraulic supporting pressure introduced into cylinder chamber 48 through pressure inlet 33. In addition to showing support assembly 17 and part of pressure balance 14 in greater detail, it will be noted that FIG. 3 also shows other components enclosed by dash-dot lines in FIG. 1.

As is indicated in both FIGS. 1 and 3, the aforesaid pressure inlet 33 is connected by a pressure line 21 with a pressure-regulating valve 19. Valve 19 is connected by a pressure supply line 18 with any desired source of fluid under pressure. Valve 19 includes spring-biased control means 20 that is continuously adjustable. The fluid pressure within the line 21 downstream of valve 19 is regulated by and is a function of the adjustment of control means 20. The magnitude of the adjusted pressure within line 21 determines the difference between the pump pressure and the load pressure which is caused to exist at throttle valve 1 and pressure balance 14, and thus determines the flow behavior of the throttle valve.

During operation of the apparatus shown in FIGS. 1 and 3, valve 1 controls the volume flow of hydraulic fluid from pump 49 to consumer 10, and the return flow from consumer 10 to tank 22. Arrows 2 and 3 indicate control motions of and control forces upon the opposite end portions 5, 6 of the piston of valve 1. Such forces displace the valve piston desired extents to the left or to the right from its central "idling" position 4 shown in FIG. 1. Pump line 7 is connected with tank line 23 via bypass line 50. Pressure balance 14 is disposed within bypass line 50. The position of piston 26 of balance 14 is controlled in part by the pressure in pump line 7, on the one hand, and on the other hand by the opposing biasing force of spring 16 and the consumer load pressure transmitted to the pressure balance by line 15. The spring abutment 27 is supported by supporting assembly 17. Assembly 17 is manually adjusted by adjustment of pressure regulating valve 19, which is connected with any desired source of pressurized fluid. This permits an operator to utilize the adjusting forces 2, 3 imposed upon throttle valve 4 to adjust both the operation and each desired operating point of the hydraulic power system. In the foregoing situation, the adjusted operating point, i.e., the adjusted volume flow of fluid, is proportional to the adjusting force 2 or 3. This characteristic is illustrated as a straight line in the diagram of FIG. 2, wherein the volume flow is shown on the ordinate 41 and the reciprocal value of the throttling resistance is shown on the abscissa 40. The reciprocal value of the throttling resistance is proportional to each magnitude of the throttle valve control signals 2 or 3. Maximum opening of throttle valve 4 is indicated by the straight line 46.

The differential pressure at valve 1 is dependent on the magnitude of the adjustable force imposed upon balance spring 16 by support assembly 17. The straight lines 42, 43 and 44 in the FIG. 2 diagram represent the effect upon the fluid volume flow of making the differential pressure a function of the control signals or forces 2 or 3, with the differential pressures being adjusted as constant values. The lines 42, 44 respectively represent the situations in which the differential pressure is the greatest and the smallest. In the situation represented by the line 44 of minimal slope, a sensitive adjustment of the flow volume is possible but the maximum volume flow is very small.

Figure 2:
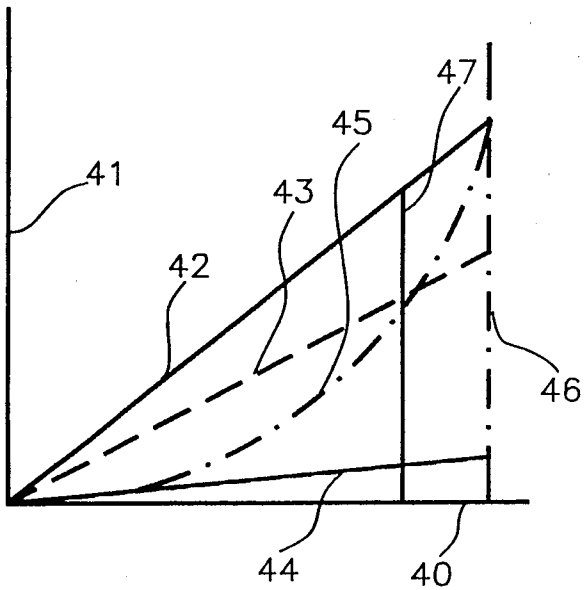
FIG. 2 is a graphical representation of the family of characteristics of components of the FIG. 1 system.

The straight line 47 of FIG. 2 represents a characteristic of the volume flow in the situation where there is a constantly adjusted opening of throttle valve 4 and a variable adjustment of the differential pressure.

Adjustment of the control means 20 associated with the pressure regulator 19 makes it possible to achieve not only any desired one of the family of characteristics illustrated by straight lines in FIG. 2, but to also achieve an entirely different characteristic such as that illustrated by the curve 45. The curve 45 starts with a first control range in which highly sensitive control of the volume flow is possible, the curve 45 being straight and having a very small slope in this range. In this control range of high sensitivity the biasing force imposed upon balance spring 16 by support assembly 17 is very low but of constant magnitude. In this control range it is possible, by very sensitive adjustment of the control forces or signals 2, 3 directed to throttle valve 4, to effect creeping motion to any desired position. This is important in the case of machine tools, for example. The aforesaid control range of high sensitivity of curve 45 is followed by a progressive range in which the differential pressure on throttle valve 1 increases simultaneously with opening of the throttle valve. This is accomplished by effecting corresponding adjustment of the control means 20 of pressure regulator 19, such that as throttle valve 1 is opened, the supporting assembly 17 is biased by higher pressure and balance spring 16 is further tightened or compressed to increase its spring force. The present invention therefore makes it possible to approach, in any desired sequence and with a smooth transition and independently of the load pressure, any point of the area defined in FIG. 2 by and between the straight line 42 (representing maximum differential pressure), by the straight line 46 (representing maximum opening of valve 4) and by the abscissa 40.

It will also be noted that in the above described embodiment, the control means 20 and the throttle valve 1 are controllable independently from each other. This independent control permits the signal pressure to the pressure balance to be modified so as to obtain a desired characteristic in the range between lines 42 and 44 in FIG. 2.

In the following description of other embodiments of the invention, components identical or similar to ones described in a prior embodiment are designated by the same reference numerals with the addition of a suffix letter.

Figure 4:
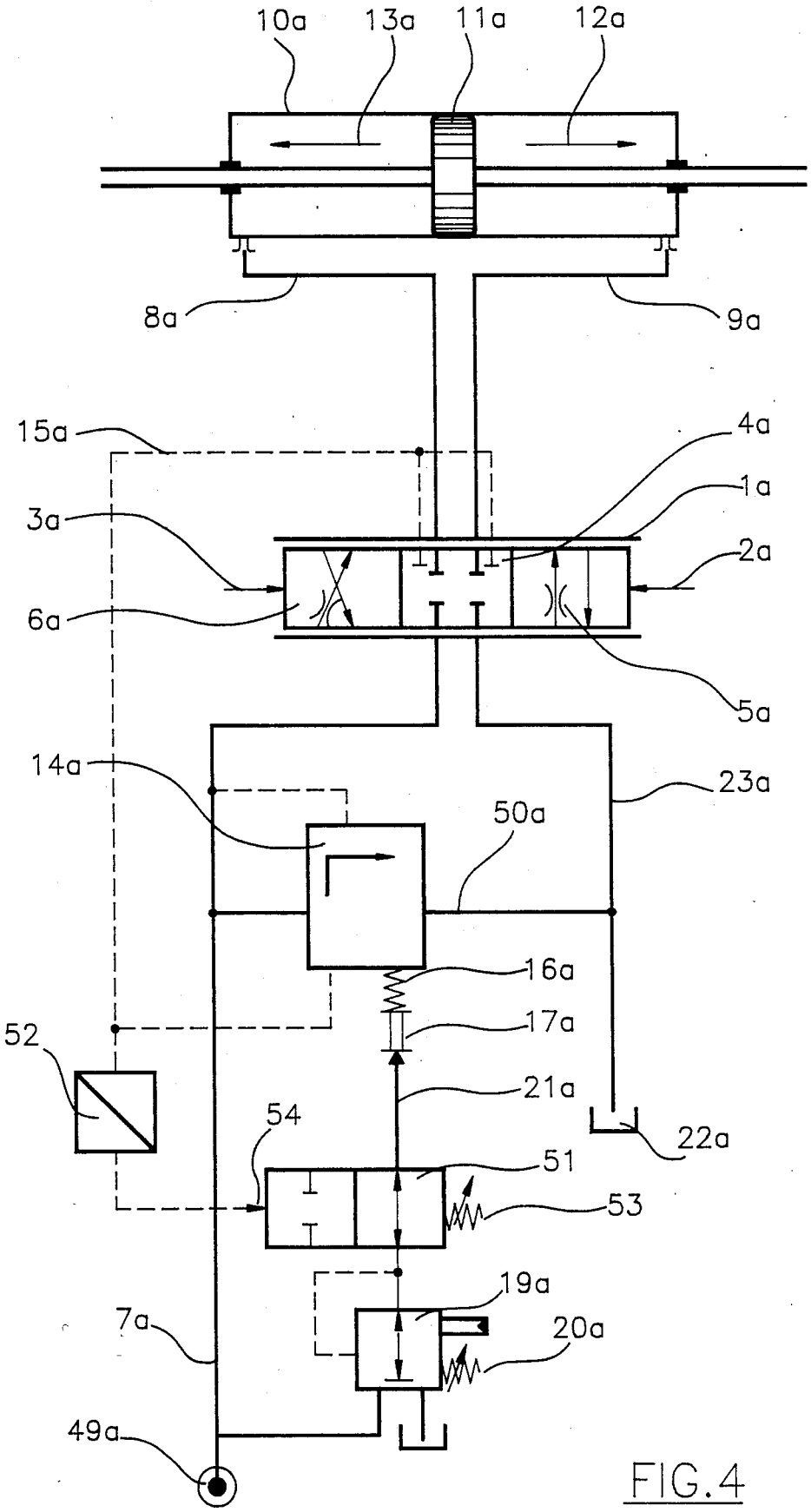
FIGS. 4 and 5 are schematic circuit diagrams of hydraulic systems that include pressure balances and valve apparatus in accordance with other embodiments of the invention.

In keeping with that shown in FIG. 1, the apparatus of FIG. 4 includes a consumer working cylinder 10*a* having a piston 11*a* which can be biased or driven in the direction 12*a* or 13*a* by pressure conducted to the cylinder by line 8*a* or 9*a*. A multiway (4/3) throttle valve 1*a* controls working cylinder 10*a*. Multiway valve 1*a* is controlled by forces 2*a* and 3*a*, respectively, and is connected by line 7*a* with pump 49*a*. A return flow line 23*a* interconnects multiway valve 1*a* and tank 22*a*. Pressure balance 14*a* is disposed in the bypass line 50*a* between pump line 7*a* and tank line 23*a*. The pressure balance corresponds generally to that disclosed in the hereinbefore cited European patent and to that fragmentarily shown in FIG. 3. The pressure balance is biased on one side by the pressure within pump line 7*a*, and on its other side by the load pressure within signalling line 15*a*. Balance spring 16*a* also acts upon the load pressure side. Supporting assembly 17*a* supports the abutment of spring 16*a* with an adjustable hydraulic force. Constantly adjustable pressure regulator 19*a* controls operation of supporting assembly 17*a* and exerts a hydraulic biasing pressure thereon via interconnecting pressure line 21*a*. A desired operating point for the supporting assembly 17*a* may be preset by adjustment of spring biased control means 20*a* of pressure regulator 19*a*. As a result of the foregoing, the pressure differential on pressure balance 14*a* and multiway valve 1*a* is preset, and there is a selection of one of the straight line characteristics from the family thereof that includes those designated by the numerals 42, 43 and 44 in FIG. 2.

The embodiment of FIG. 4 differs from the previously described embodiment of FIGS. 1 and 3 in its inclusion of a pilot valve 51 within the line 21*a* interconnecting support assembly 17*a* and pressure regulator 19*a*. Additionally, the FIG. 4 apparatus includes a transformer or converter 52 which receives input from a branch of pressure signalling line 15 and which produces a hydraulic, pneumatic or electric signal or force 54 upon pilot valve 51. Valve 51 is a controllable multiway (2/2) valve having adjustable spring-type control means 53, the adjustment of which determines the magnitude of the force 54 to which the valve responds. The magnitude of the adjusting force 54 directed by converter or transformer 52 to pilot valve 51 is a function of the consumer or load pressure which is detected at multiway valve 1*a* and transmitted via line 15*a* to both pressure balance 14*a* and converter 52. By appropriate adjustment of the adjustable spring-biased means 53 of valve 51, it is therefore possible to cause supporting assembly 17*a* to be connected to pressure regulator 19*a* when a predetermined load pressure is reached. This in turn effects adjustment of the operating position or condition of supporting assembly 17*a*. It is therefore possible to set the control means of the apparatus to achieve a desired result such as, for example, rapid motion of the consumer when the load thereon falls below a certain preset value.

Figure 5:
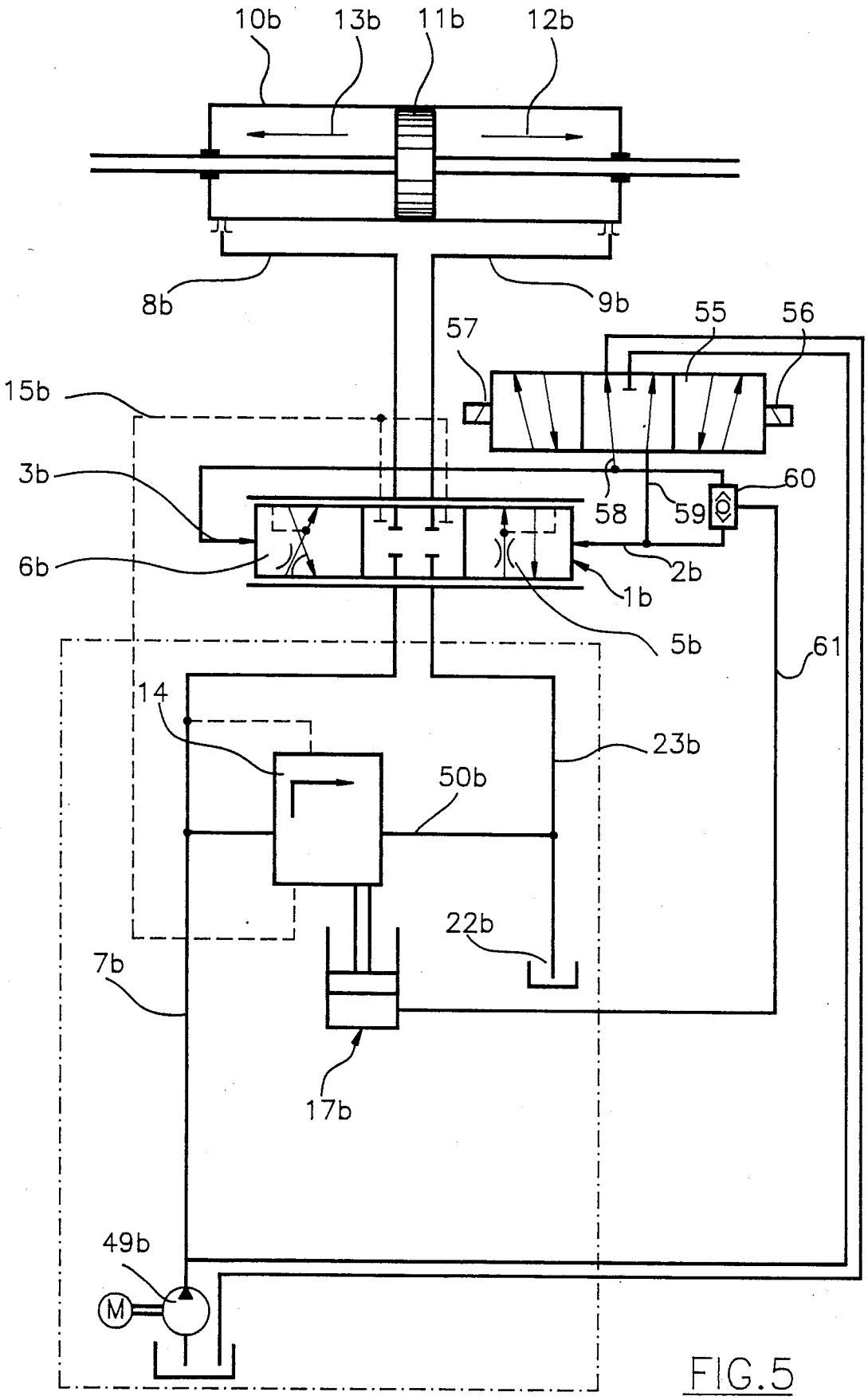
Figure 6:
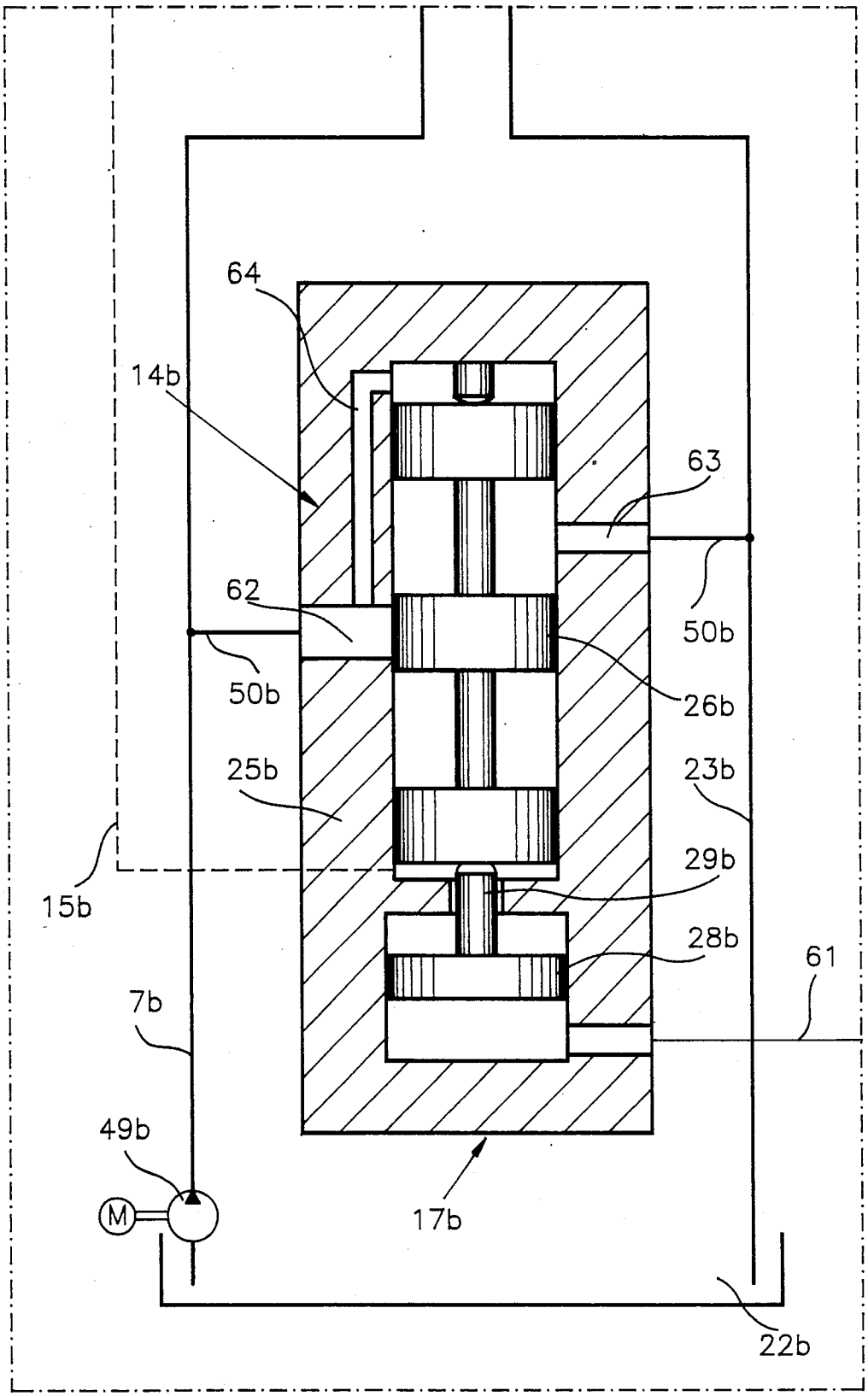
FIG. 6 is a partially schematic and partially sectional view showing in greater detail the pressure balance and related components of the FIG. 5 system.

FIGS. 5 and 6 illustrate another embodiment wherein, as in those previously described, the working piston 11*b* of hydraulic consumer 10*b* is movable in the operating direction 12 or 13 by the biasing hydraulic pressure conducted thereto via line 8*b* or 9*b*. Control is realized by multiway (4/3) throttle valve 1*b*. which is connected via line 7*b* with pump 49*b* and via return line 23*b* with tank 22*b*. The embodiment of FIGS. 5 and 6 differs primarily from that of FIGS. 1–3 in its inclusion of a pilot valve 55 and a two-way valve 60, and in the configuration of its supporting assembly 17*b*.

More specifically in the foregoing regard, pilot valve 55 controls the operation of multiway valve 1*b*. Valve 55 may be of the known type disclosed in German Patent No. 2428287. Suitable lines connect valve 55 with pump 49*b* and with a hydraulic fluid sump or tank. By appropriate control of its magnetic actuators 56, 57, pilot valve 55 is caused to produce control pressure at its outlets 58, 59 which adjusts the position of the piston of multiway throttle valve 1*b*. The control pressure is simultaneously supplied to the two-way valve 60, which transmits the higher pressure via line 61 to the supporting assembly 17*b* associated with pressure balance 14*b*. The latter components, which are shown only schematically in FIG. 5, are shown in greater detail in FIG. 6, along with some of the adjacent components also enclosed by the dash-dot line of FIG. 5.

Referring now primarily to FIG. 6, the housing 25*b* of pressure balance 14*b* has an inlet 62 communicating with pump 49*b* and an outlet 63 communicating with tank 22*b*. A balance piston 26*b* within housing 25*b* controls the passage of fluid between pump inlet 62 and tank outlet 63. Inlet 62 and outlet 63 together form bypass means 50*b* between pump line 7*b* and tank line 23*b*. One end (the upper end, as viewed in FIG. 6) of balance piston 26*b* is subjected to and biased by the pump pressure conducted thereto by line 64. The other (illustratively lower) end of piston 26*b* is biased by the load pressure conducted thereto by line 15*b*. This other end of piston 26*b* is also engaged by a plunger 29*b* which is hydraulically biased by an adjusting piston 28*b* having a cross-section and end surface of greater area than that of balance piston 26*b*. Supporting piston 28*b* is exposed to and biased by the higher pre-control pressure conducted thereto by line 61 from the outlet of two-way valve 60 (FIG. 5).

As is apparent from FIG. 6, the pressure balance 14*b* does not require or include a supporting balance spring such as provided in the pressure balances of the previously described embodiments. The mechanical force which is applied to the balance piston in the same operational direction as the load pressure, for the purpose of achieving a constant pressure difference between the pump pressure and the load pressure, is in the present embodiment produced by hydraulic support means which is dependent upon the control pressure within line 61, and is not produced by a balance spring. The advantage of this hydraulic signal transmission, and without a spring, is that a substantially horizontal characteristic can be obtained in a diagram of the flow stream vs. pressure. Where a mechanical spring is employed, a sloping characteristic is obtained by reason of the superposition of the influence of the spring characteristic.

Figure 7:
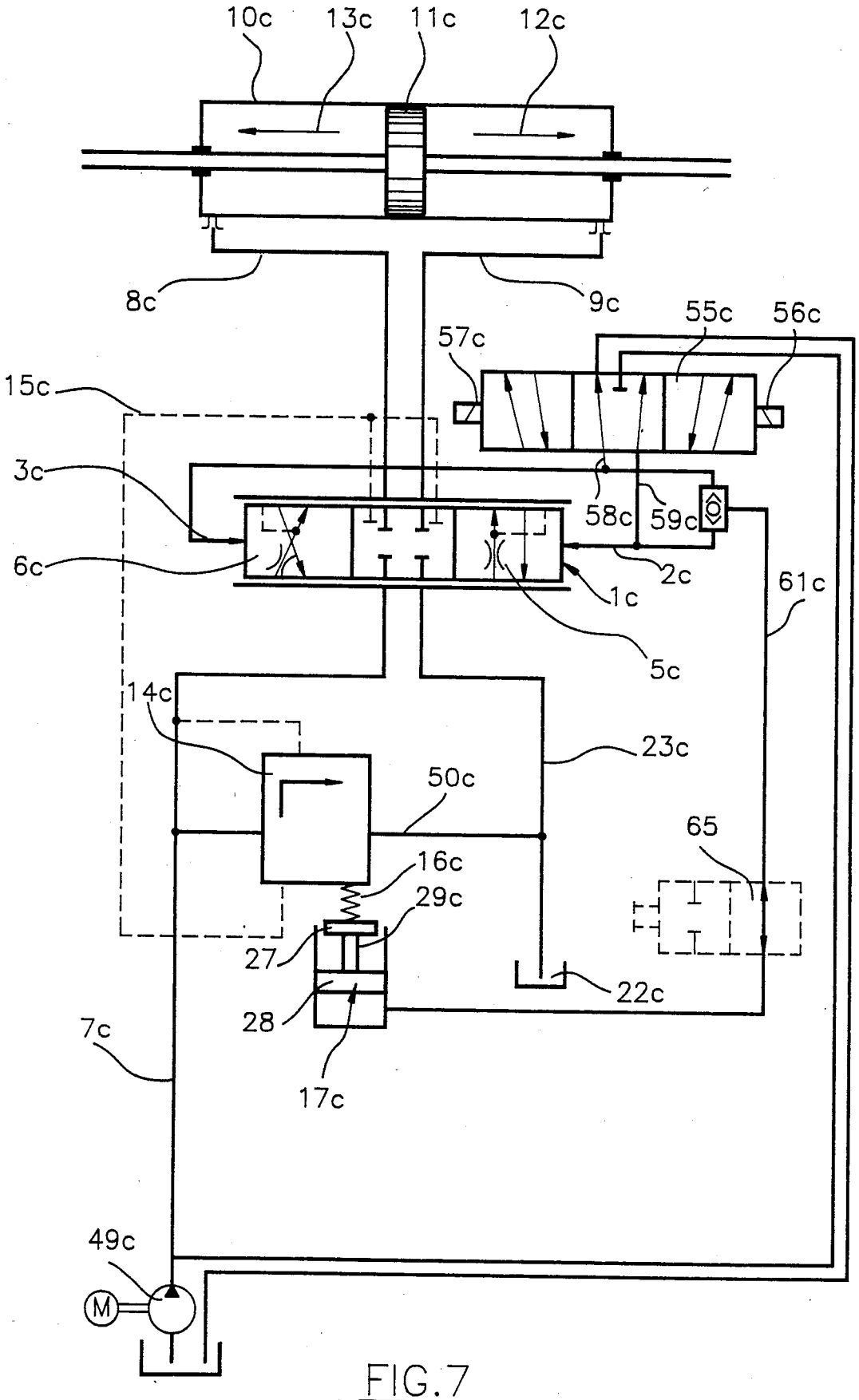
FIG. 7 is a schematic circuit diagram of a hydraulic system in accordance with another embodiment having a pressure balance supported by a spring.

It should be noted, however, that it is also possible to control a pressure balance having a balance spring in the above-described manner, i.e., as a function of the precontrol pressure within line 61. Such an embodiment is shown in FIG. 7, wherein the piston 28*c* of supporting assembly 17*c* is connected by plunger 29*c* to abutment 27*c* of balance spring 16*c*. The operation of the FIG. 7 apparatus otherwise corresponds to that of the apparatus of FIGS. 5 and 6. However, in FIG. 7 an additional pilot valve 65 may be and illustratively is provided to assist in connecting and disconnecting the control force of the balance spring 16*c* as a function of the pilot pressure. Apparatus as shown in FIGS. 5 and 6 or 7 is able to achieve characteristics which approximately correspond, for example, to the curve 45 of FIG. 2. However, such a characteristic depends primarily upon the design of the supporting piston 28.

While preferred embodiments of the invention have been specifically shown and described, this was for purposes of illustration only, and not for purposes of limitation, the scope of the invention being in accordance with the following claims.

We claim:

1. Proportional action valve apparatus for a hydraulic power system having a pump and a load and a tank comprising:

adjustable throttle valve means connected directly to said pump for controlling hydraulic fluid flow from said pump to said load and to said tank;

pressure balance means for controlling the pressure difference at said throttle valve means between the pump pressure and the load pressure, said pressure balance means having a passage interconnecting said pump and said tank, said pressure balance means including a piston biased on one side thereof by said pump pressure in a direction increasing the flow area of said passage, and biased on the other side thereof by said load pressure in a direction decreasing the flow area of said passage;

a supporting assembly for imposing additional hydraulic pressure on said other side of said piston;

and adjustable control means for selectively controlling the magnitude of said additional pressure, said control means including hydraulic fluid circuit means extending between a source of pressurized fluid and said supporting assembly, an adjustable pressure regulating valve located within said circuit means between said source and said supporting assembly, and a second valve in series with said pressure regulating valve and operable by changes in said load pressure.

2. Apparatus as in claim 1, wherein said pressure balance means further includes a balance spring imposing an additional force against said other side of said piston.

3. Apparatus as in claim 1, wherein said control means is operable independently of said throttle valve means.

4. Proportional action valve apparatus for a hydraulic power system having a pump and a load and a tank, comprising:

adjustable throttle valve means connected directly to said pump for controlling hydraulic fluid flow from said pump to said load and to said tank;

pressure balance means for controlling the pressure difference at said throttle valve means between the pump pressure and the load pressure, said pressure balance means having a passage interconnecting said pump and said tank, said pressure balance means including a balance piston biased on one side thereof by said pump pressure in a direction increasing the flow area of said passage, and biased on the other side thereof by said load pressure in a direction decreasing the flow area of said passage;

a supporting assembly for imposing additional hydraulic pressure on said other side of said balance piston, and including a supporting piston positioned to operatively engage said other side of said balance piston;

and adjustable control means which is operable independently of said throttle valve means for selectively controlling the magnitude of said additional pressure, said control means including hydraulic fluid circuit means extending between a source of pressurized fluid and said supporting piston and an independently adjustable pressure regulating valve located within said circuit means between said source and said supporting piston for independently controlling the magnitude of the pressurized fluid applied to said supporting piston and thus the magnitude of the additional hydraulic force imposed on said other side of said balance piston.

* * * * *